US006996246B2

(12) United States Patent
Ito

(10) Patent No.: US 6,996,246 B2
(45) Date of Patent: Feb. 7, 2006

(54) SPEAKER APPARATUS

(75) Inventor: Masanori Ito, Tendo (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 15 days.

(21) Appl. No.: 10/410,441

(22) Filed: Apr. 10, 2003

(65) Prior Publication Data

US 2003/0202675 A1 Oct. 30, 2003

(30) Foreign Application Priority Data

Apr. 30, 2002 (JP) ..... 2002-129055

(51) Int. Cl.
*H04R 25/00* (2006.01)

(52) U.S. Cl. ..... 381/398; 381/423; 381/430

(58) Field of Classification Search ..... 351/398, 351/423, 424, 430, 433, 386, 391, 189, 395, 351/396; 181/171, 172, 173
See application file for complete search history.

(56) References Cited

U.S. PATENT DOCUMENTS

| | | | | |
|---|---|---|---|---|
| 5,748,759 | A | 5/1998 | Croft et al. | |
| 5,883,967 | A * | 3/1999 | House | 381/398 |
| 5,892,185 | A * | 4/1999 | Takahashi et al. | 181/171 |
| 5,949,898 | A * | 9/1999 | Proni | 381/398 |
| 6,751,332 | B2 * | 6/2004 | Kobayashi et al. | 381/386 |

FOREIGN PATENT DOCUMENTS

| | | |
|---|---|---|
| DE | 1235337 | 3/1967 |
| FR | 641.542 | 8/1928 |
| JP | 6060295 | 12/1985 |
| WO | WO 02/058433 A1 | 7/2002 |

* cited by examiner

*Primary Examiner*—Huyen Le
(74) *Attorney, Agent, or Firm*—Sughrue Mion, PLLC

(57) ABSTRACT

A speaker apparatus is provided. A frame has a projecting portion projecting toward a diaphragm at the periphery of the frame. The diaphragm has a rising portion extending opposite to the frame from the periphery of the diaphragm and having an outside surface along an inside surface of the frame projecting portion. The outside surface of the rising portion is adhered to the inside surface of the frame projecting portion.

18 Claims, 3 Drawing Sheets

SPEAKER APPARATUS

BACKGROUND OF THE INVENTION

1. Field of the Invention

The present invention relates generally to a speaker apparatus and, more particularly, to a speaker apparatus wherein a periphery of a diaphragm is supported by a frame.

2. Description of the Related Art

A dome-speaker shown in FIGS. 7A,7B is conventionally suggested as an example of the above speaker apparatus. FIG. 7A is an exploded half-sectional view showing a prior art dome-speaker. FIG. 7B is a half-sectional view showing the prior art dome-speaker of FIG. 7A.

In this dome-speaker, a circular pole plate 10, a magnet 11, and a yoke 12 constitute a magnetic circuit having a ring-like magnetic gap 13. The magnetic gap 13 is formed between a side surface of the pole plate 10 and an inner surface of the yoke 12. A frame 14 of resin is formed around the yoke 12. The magnetic circuit and the frame constitute an frame assembly.

A diaphragm 15 is arranged over the frame assembly. The diaphragm 15 is in a circular or elliptic shape. The diaphragm 15 has a vibrating portion 16 having a dome shape, a recess (or a groove) 17 provided along the peripheral edge of the vibrating portion 16, an edge damper 18*a* provided along the peripheral edge of the recess 17, and an edge damper frame 18*b* provided along the peripheral edge of the edge damper 18*a*. The edge damper frame 18*b* is provided along a horizontal support plane 14*b* of the frame 14.

The diaphragm 15 is provided with a rising portion 18*c* which vertically stands from the peripheral edge of the edge damper frame 18*b*. The rising portion 18*c* is provided along an inside surface 14*a*-1 of a projecting portion 14*a* formed outside the horizontal support plane 14*b* of the frame 14. The diaphragm 15 is provided with an engaging portion 18*d* formed from the top of the rising portion 18*c*. The engaging portion 18*d* is a plane parallel to a radial direction of the diaphragm 15. The engaging portion 18*d* engages an inside surface 14*a*-2 of the projecting portion 14*a*.

The edge damper 18*a*, the edge damper frame 18*b*, the rising portion 18*c* and the engaging portion 18*d* constitute an edge portion 18. The vibrating portion 16, the recess 17 and the edge portion 18 are integrally formed of a single resin film and constitute the diaphragm 15.

The diaphragm 15 is arranged such that the rising portion 18*c* abuts the inside surface 14*a*-1 of the projecting portion 14*a* of the frame 14. The diaphragm 15 is attached to the frame assembly such that the center of the diaphragm 15 aligns with the center of the frame assembly. Positioning of the diaphragm 15 in a radial direction thereof with respect to the frame 14 can be done by the rising portion 18*c*.

When the above edge damper frame 18*b* is arranged on the horizontal support plane 14*b* provided of the frame 14, the recess 17 is arranged in the magnetic gap 13. Positioning of the diaphragm 15 in an axial direction thereof with respect to the frame 14 can be done by the edge damper frame 18*b*.

As above, the recess 17 can be properly arranged in the magnetic gap 13 of the magnetic circuit. A voice coil 19, which is formed by winding an electric wire, is adhered to the recess 17. The voice coil 19 is elastically supported by the edge damper 18*a* in the magnetic gap 13 along with the recess 17.

In the above speaker apparatus, the diaphragm 15 is attached to the frame 14 by adhering the edge damper frame 18*b* of the diaphragm 15 to the horizontal support plane 14*b* of the frame 14 with an adhesive. A frame cover 20 to protect the diaphragm 15 is provided over the diaphragm 15.

Generally, a speaker apparatus with a larger vibration area can generate a lager sound volume at a low frequency band (i.e. the lower register) due to a larger mass of the diaphragm and accordingly due to a lower minimum resonance frequency. And also, a speaker apparatus with a larger vibration area can generate a lager sound volume at a low frequency band due to a higher radiation impedance and due to a higher-sensitivity sound pressure characteristic.

With respect to the above prior art dome-speaker, however, the diaphragm 15 is attached to the frame 14 by adhering the edge damper frame 18*b* of the diaphragm 15 to the horizontal support plane 14*b* of the frame 14 with an adhesive. An adherence area needs to be larger for enhancing the strength of adherence.

That is, the width of the horizontal support plane 14*b* and that of the edge damper frame 18*b* need to be large for obtaining a sufficient adherence strength. In this case, the diameter of the vibrating portion 16 and that of the edge damper 18*a* become small. That is, the vibration area becomes small.

SUMMARY OF THE INVENTION

In view of the foregoing, an object of the present invention is to provide a speaker apparatus wherein a playback at low frequencies is possible by making a minimum resonance frequency small by enlarging a vibration area and the sound pressure sensitivity is large.

In order to achieve the above object, as a first aspect of the present invention, a speaker apparatus comprises: a diaphragm; a frame arranged under the diaphragm and supporting a periphery of the diaphragm, wherein the frame has, at a periphery thereof, a frame projecting portion extending toward the diaphragm, the diaphragm has a rising portion extending opposite to the frame from the periphery of the diaphragm and having an outside surface along an inside surface of the frame projecting portion, and the outside surface of the rising portion is adhered to the inside surface of the frame projecting portion.

As a second aspect of the present invention, a speaker apparatus comprises: a diaphragm; a frame arranged under the diaphragm and supporting a periphery of the diaphragm, wherein the frame has, at a periphery thereof, a frame projecting portion extending toward the diaphragm, the diaphragm has a falling portion extending toward the frame from the periphery of the diaphragm and having an inside surface along an outside surface of the frame projecting portion, and the inside surface of the falling portion is adhered to the outside surface of the frame projecting portion.

As a third aspect of the present invention, based on the first aspect, the inside surface of the frame projecting portion is perpendicular to a radial direction of the diaphragm.

As a fourth aspect of the present invention, based on the second aspect, the outside surface of the frame projecting portion is perpendicular to a radial direction of the diaphragm.

As a fifth aspect of the present invention, based on the first aspect, the inside surface of the frame projecting portion is inclined about a bottom end of the inside surface outwardly with respect to an axial direction of the diaphragm.

As a sixth aspect of the present invention, based on the second aspect, the outside surface of the frame projecting portion is inclined about a bottom end of the outside surface inwardly with respect to an axial direction of the diaphragm.

As a seventh aspect of the present invention, based on the fifth aspect, an angle of inclination of the inside surface of the frame with respect to the axial direction is not more than 45 degrees.

As an eighth aspect of the present invention, based on the sixth aspect, an angle of inclination of the outside surface of the frame with respect to the axial direction is not more than 45 degrees.

According to the above-described structures of the present invention, the following advantages are provided.

(1) Because the outside surface of the rising portion of the diaphragm is adhered to the inside surface of the frame projecting portion of the frame, a horizontal portion, of the diaphragm, for adherence can be eliminated, thereby enlarging a vibration area. Therefore, a playback at low frequencies is possible by making a minimum resonance frequency small, and the sound pressure sensitivity can be large.

(2) Because the inside surface of the falling portion of the diaphragm is adhered to the outside surface of the frame projecting portion of the frame, a horizontal portion, of the diaphragm, for adherence can be eliminated, thereby enlarging a vibration area. Besides, because a projecting portion is not necessary outside an outside surface of the falling portion, the vibration area can be further enlarged. Therefore, a playback at low frequencies is possible by making a minimum resonance frequency small, and the sound pressure sensitivity can be large.

(3) Because the inside surface of the frame projecting portion is provided in a manner perpendicular to the radial direction of the diaphragm, a horizontal portion, of the diaphragm, for adherence can be eliminated, thereby enlarging a vibration area. Therefore, a playback at low frequencies is possible by making a minimum resonance frequency small, and the sound pressure sensitivity can be large.

(4) Because the outside surface of the frame projecting portion is provided in a manner perpendicular to the radial direction of the diaphragm, a horizontal portion, of the diaphragm, for adherence can be eliminated, thereby enlarging a vibration area. Therefore, a playback at low frequencies is possible by making a minimum resonance frequency small, and the sound pressure sensitivity can be large.

(5) When the outside surface of the rising portion is adhered to the inside surface of the frame projecting portion with an adhesive, the adhesive can be prevented from dripping because the inside surface of the frame projecting portion is inclined.

(6) When the inside surface of the falling portion is adhered to the outside surface of the frame projecting portion with an adhesive, the adhesive can be prevented from dripping because the outside surface of the frame projecting portion is inclined.

(7) The frame and the horizontal plane each are provided with the horizontal plane so as to vertically position the diaphragm with respect to the frame. When the angle of inclination of the inside surface of the frame are not more than 45 degrees, the vibration area can be large.

(8) The frame and the horizontal plane each are provided with the horizontal plane so as to vertically position the diaphragm with respect to the frame. When the angle of inclination of the outside surface of the frame are not more than 45 degrees, the vibration area can be large.

The above and other objects and features of the present invention will become more apparent from the following description taken in conjunction with the accompanying drawings.

DESCRIPTION OF THE PREFERRED EMBODIMENT(S)

Embodiment(s) of the present invention will now be described in further detail with reference to the accompanying drawings.

Figure 1:
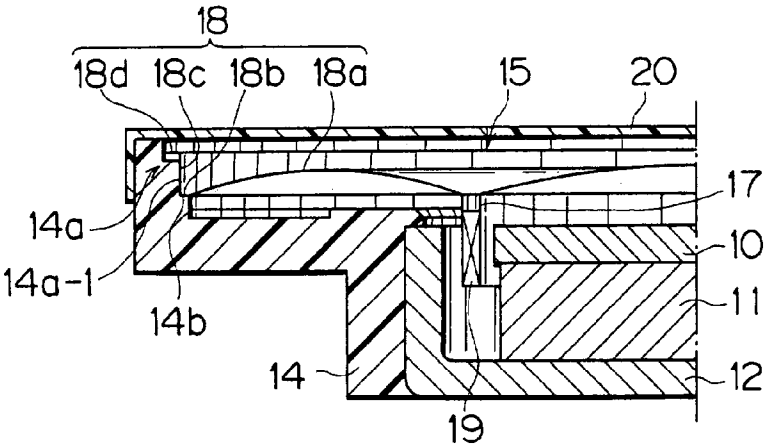
FIG. 1 is a half-sectional view showing the first embodiment of the inventive speaker apparatus.

FIG. 1 is a half-sectional view showing the first embodiment of the inventive speaker apparatus.

Figure 7A:
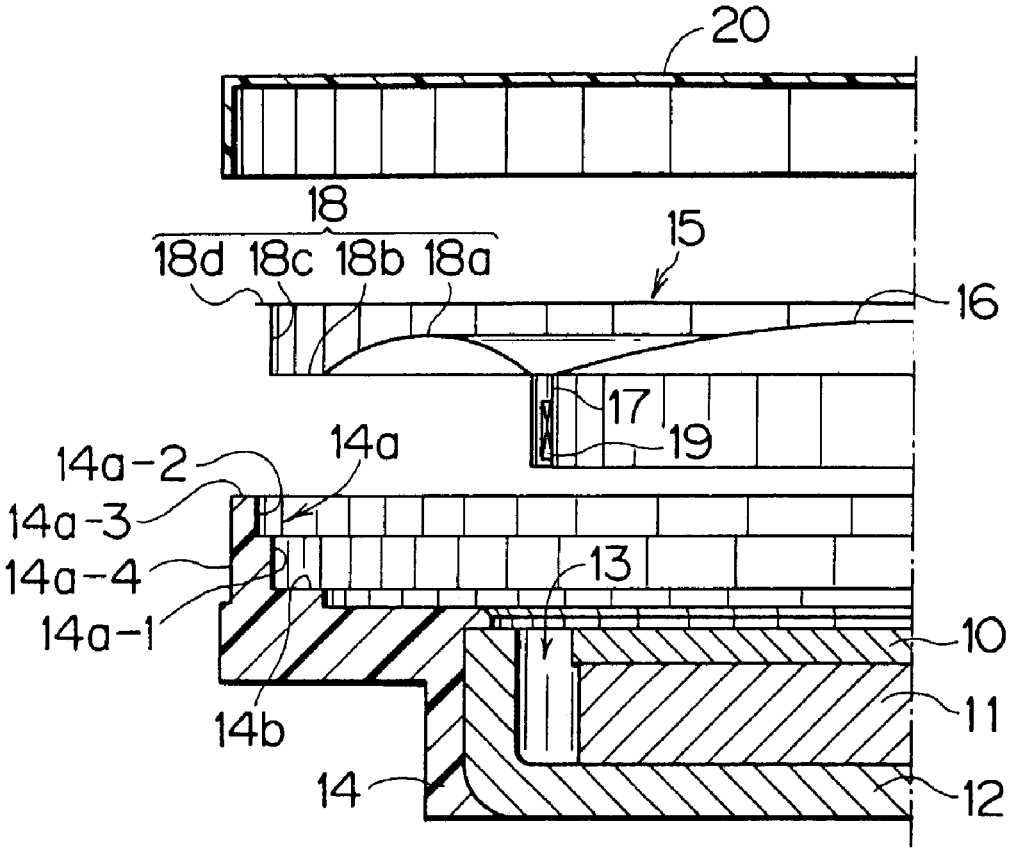
PRIOR ART FIG. 7A
FIG. 7A is an exploded half-sectional view showing a prior art speaker apparatus.
Figure 7B:
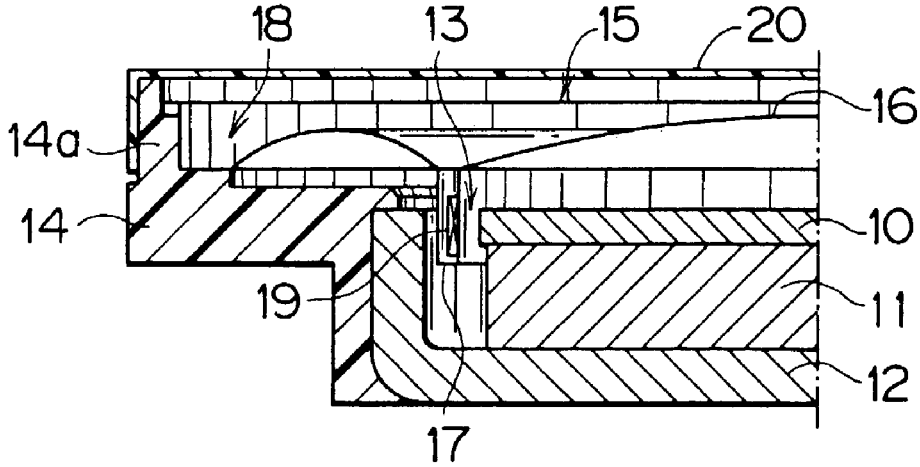
PRIOR ART FIG. 7B
FIG. 7B is a half-sectional view showing the prior art speaker apparatus of FIG. 7A.

An adhering portion of a frame 14 and a diaphragm 15 of the present invention differs from that of the prior art speaker apparatus shown in FIG. 7. In the prior art speaker apparatus, the horizontal support plane 14*b* of the frame 14 and the edge damper frame 18*b* of the diaphragm 15 are adhered to each other with an adhesive. However, in the present invention, a rising portion 18*c* of the diaphragm 15 is adheres to an inside surface 14*a*-1 of a frame projecting portion 14*a* with an adhesive. That is, the surfaces both perpendicular to the radial direction are adhered to each other.

As above, because the surfaces both perpendicular to the radial direction are adhered to each other, a horizontal support plane 14*b* only needs to have an area enough to axially position the diaphragm. Therefore, the horizontal support plane 14*b* can be small, thereby enlarging a vibration area. Therefore, a playback at low frequencies is possible by making a minimum resonance frequency small, and the sound pressure sensitivity can be large.

Figure 2:
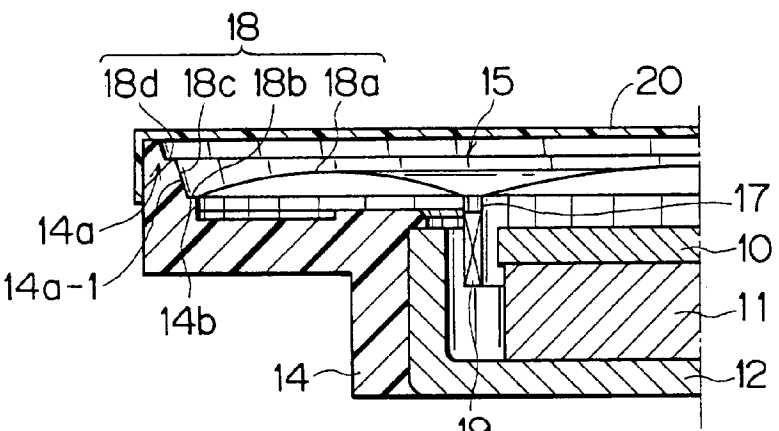
FIG. 2 is a half-sectional view showing the second embodiment of the inventive speaker apparatus.

In the first embodiment, the inside surface 14*a*-1 of the frame projecting portion 14*a* is perpendicular to the radial direction. Therefore, when an adhesive is applied to the inside surface 14*a*-1 of the projecting portion 14*a*, the adhesive is likely to drip in a vertical direction. In the second embodiment, as shown in FIG. 2, the inside surface 14*a*-1 is inclined outward about the lower end thereof so as to prevent the adhesive from dripping. When the inclination angle is not more than 45 degrees, the vibration area can be securely large even if the horizontal support plane 14*b* and the edge damper frame 18*b* are considered. The horizontal support plane 14*b* and the edge damper frame 18*b* are necessary for positioning the diaphragm 15 in a vertical direction (i.e. the axial direction of the speaker apparatus).

Figure 3:
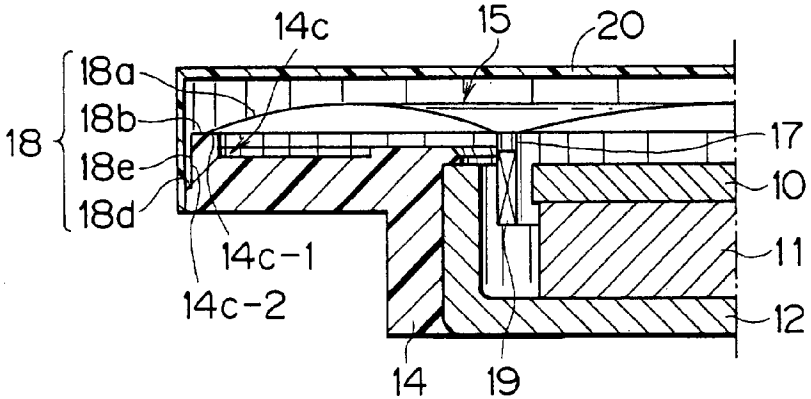
FIG. 3 is a half-sectional view showing the third embodiment of the inventive speaker apparatus.

Next, the third embodiment is described with reference to FIG. 3. In the third embodiment, the shape of the frame 14 is different from those of the previous embodiments. In the first and the second embodiments, each frame 14 has the projecting portion 14*a* arranged outside the diaphragm 15. In the third embodiment, the frame 14 has a projecting portion 14*c* arranged inside the diaphragm 15. A horizontal support plane 14*c*-1 to support the edge damper frame 18*b* and to vertically position the diaphragm 15 with respect to the frame 14 is formed on the top of the projecting portion 14*c*.

The shape of the edge portion 18 of the diaphragm 15 is also different from those of the first and the second embodiments. In the first and the second embodiments, the edge portion 18 has the rising portion 18*c* standing toward the frame cover 20 from the peripheral edge of the edge damper frame 18*b*.

The edge portion 18 of the third embodiment has a falling portion 18*e* falling vertically from the peripheral edge of the edge damper frame 18*b*. The falling portion 18*e* is provided along an outside surface 14*c*-2 of the projecting portion 14*c*. An inside surface of the falling portion 18*e* is adhered to the outside surface 14*c*-2 of the projecting portion 14*c* with an adhesive.

An engaging portion 18*d* is provided on a bottom end portion of the falling portion 18*e*. The engaging portion 18*d* abuts the inside surface of the frame cover 20.

In the third embodiment, similarly to the first and the second embodiments, because the surfaces both perpendicular to the radial direction are adhered to each other, the horizontal support plane 14*c*-1 and the edge damper frame 18*b* only need to have respective areas enough to axially position the diaphragm 15. Therefore, the horizontal support plane 14*c*-1 and the edge damper frame 18*b* can be small, thereby enlarging a vibration area. Therefore, a playback at low frequencies is possible by making a minimum resonance frequency small, and the sound pressure sensitivity can be large.

In the third embodiment, the falling portion 18*e* of the diaphragm 15 extends along the outside surface 14*c*-2 of the projecting portion 14*c* from the edge damper frame 18*b*. Therefore, a projecting portion is not necessary outside an outside surface of the falling portion 18*e*.

Therefore, the vibration area including the vibrating portion 16 and the edge damper 18*a* can be larger. Therefore, a playback at low frequencies is possible by making a minimum resonance frequency small, and the sound pressure sensitivity can be large.

Figure 4:
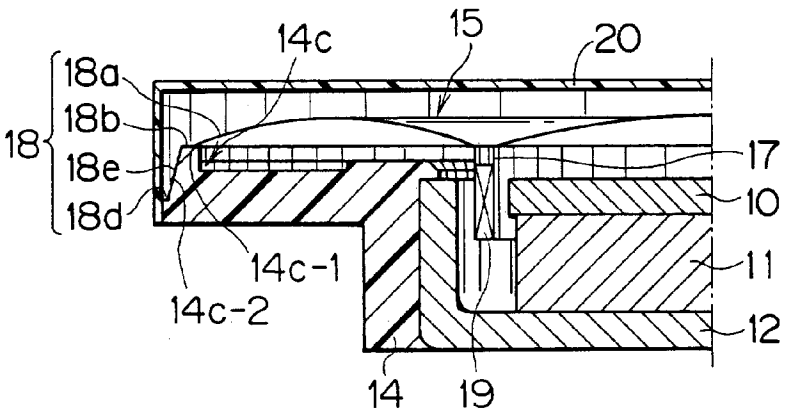
FIG. 4 is a half-sectional view showing the fourth embodiment of the inventive speaker apparatus.

In the third embodiment, the outside surface 14*c*-2 of the projecting portion 14*c* is perpendicular to the radial direction. Therefore, when an adhesive is applied to the outside surface 14*c*-2 of the projecting portion 14*c*, the adhesive is likely to drip in a vertical direction. In the fourth embodiment, as shown in FIG. 4, the outside surface 14*c*-2 is inclined inward about the lower end thereof so as to prevent the adhesive from dripping. When the inclination angle is not more than 45 degrees, the vibration area can be securely large even if the horizontal support plane 14*c*-1 and the edge damper frame 18*b* are considered.

Figure 5:
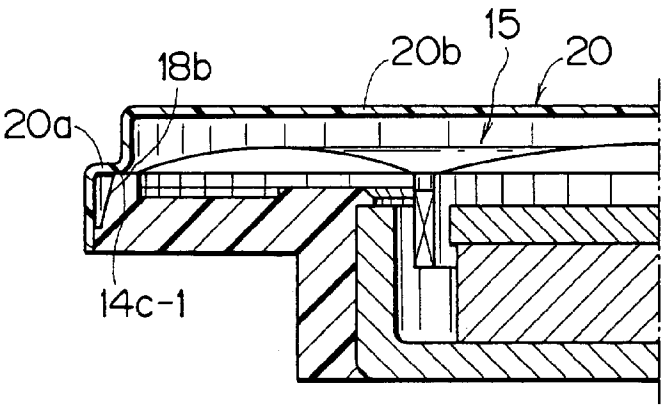
FIG. 5 is a half-sectional view showing the fifth embodiment of the inventive speaker apparatus.

In the third and the fourth embodiments, there is not a portion positioning a frame cover 20 in a vertical direction. In the fifth embodiment, as shown in FIG. 5, the frame cover 20 has a peripheral surface 20*a* and an inside plane 20*b*. The peripheral surface 20*a* as well as the edge damper frame 18*b* of the diaphragm 15 is supported by the horizontal support plane 14*c*-1.

Figure 6B:
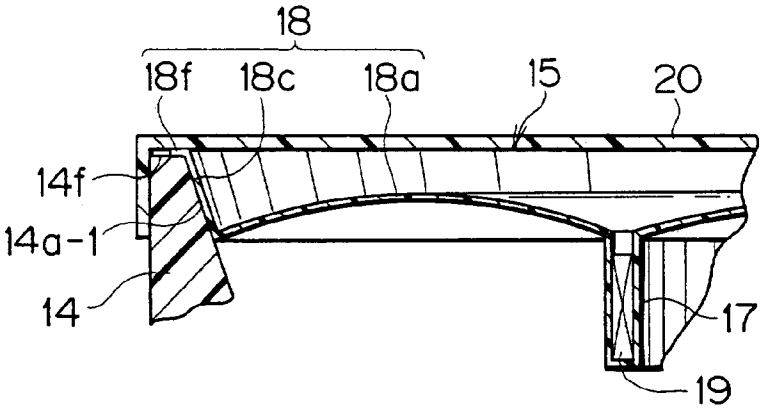
FIGS. 6A,6B,6C are partly enlarged sectional views showing the sixth embodiment of the inventive speaker apparatus.
Figure 6C:
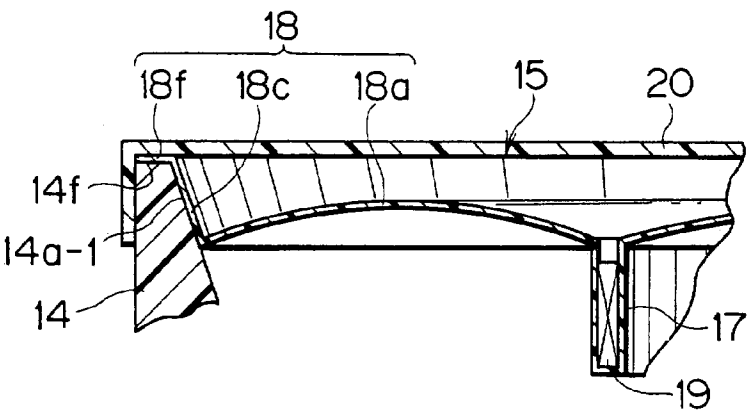
Figure 6A:
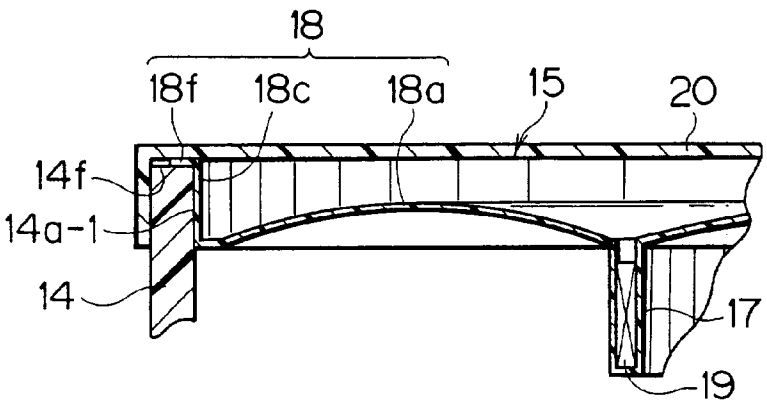

In the first and the second embodiments, the diaphragm 15 is vertically positioned with respect to the frame 14 by means of the edge damper frame 18*b* provided on the peripheral edge of the edge damper 18*a*. In the sixth embodiment, as shown in FIGS. 6A,6B, the diaphragm 15 is provided with a collar portion 18*f* continuing from the rising portion 18*c* along a horizontal plane 14*f* continuing from the inside surface 14*a*-1 of the frame 14. The diaphragm 15 is vertically positioned by the collar portion 18*f*.

Referring to FIGS. 6A,6B, the collar portion 18*f* does not extend until an inside surface of the frame cover 20. As shown in FIG. 6C, the collar portion 18*f* may be extended until the inside surface of the frame cover 20.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein. Incidentally, the contents of Japanese Patent Application No. 2002-129055 is hereby incorporated by reference.

What is claimed is:

1. A speaker apparatus, comprising:

a diaphragm;

a frame arranged under the diaphragm and supporting a periphery of the diaphragm, wherein the frame has, at an outer periphery thereof, a frame projecting portion extending toward the diaphragm;

the diaphragm has a rising portion extending opposite to the frame from the periphery of the diaphragm and having an outside surface along an inside surface of the frame projecting portion;

the inside surface of the frame projecting portion is inclined about the bottom end of the inside surface outwardly with respect to an axial direction of the diaphragm; and the outside surface of the rising portion of the diaphragm is adhered to the inside surface of the frame projecting portion.

2. The speaker apparatus as set forth in claim 1, wherein an angle of inclination of the inside surface of the frame with respect to the axial direction is not more than 45 degrees.

3. The speaker apparatus as set forth in claim 1, wherein a segment of the inside surface of the frame projecting portion is substantially flat.

4. The speaker apparatus as set forth in claim 1, wherein a segment of the inside surface of the frame projecting portion is coplanar with the outside surface of the rising portion of the diaphragm.

5. The speaker apparatus as set forth in claim 1, wherein the outside surface of the rising portion of the diaphragm is adhered to a segment of the inside surface of the frame projecting portion with an adhesive.

6. The speaker apparatus as set forth in claim 5, wherein the adhesive is inhibited from dripping because the segment of the inside surface of the frame projecting portion is inclined.

7. The speaker apparatus as set forth in claim 1, further comprising:

a horizontal support plane of the frame projecting portion; and a frame cover, wherein the frame cover has a surface, at a periphery thereof, which is supported by the horizontal support plane of the frame, for positioning the frame cover in a vertical direction.

8. The speaker apparatus as set forth in claim 1, wherein the frame projecting portion is formed outside a horizontal support plane of the frame.

9. The speaker apparatus as set forth in claim 1, wherein the inside surface of the frame projecting portion is the only surface of the frame projecting portion that is adhered to any surface of the diaphragm.

10. A speaker apparatus, comprising:

a diaphragm;

a frame arranged under the diaphragm and supporting a periphery of the diaphragm, wherein the frame has, at an outer periphery thereof, a frame projecting portion extending toward the diaphragm, the diaphragm has a falling portion extending toward the frame from the periphery of the diaphragm and having an inside surface along an outside surface of the frame projecting portion, the inside surface of the falling portion is adhered to the outside surface of the frame projecting portion, and a segment of the outside surface of the frame projecting portion extends, in a substantially linear fashion, in a direction that is inclined about a bottom end of the outside surface inwardly with respect to an axial direction of the diaphragm.

11. The speaker apparatus as set forth in claim 10, wherein an angle of inclination of the segment of the outside surface of the frame projecting portion with respect to the axial direction is not more than 45 degrees.

12. The speaker apparatus as set forth in claim 10, wherein the segment of the outside surface of the frame projecting portion is substantially flat.

13. The speaker apparatus as set forth in claim 10, wherein the segment of the outside surface of the frame projecting portion is coplanar with the inside surface of the falling portion of the diaphragm.

14. The speaker apparatus as set forth in claim 10, wherein the inside surface of the falling portion of the diaphragm is adhered to the segment of the outside surface of the frame projecting portion with an adhesive.

15. The speaker apparatus as set forth in claim 14, wherein the adhesive is inhibited from dripping because the segment of the outside surface of the frame projecting portion is inclined.

16. The speaker apparatus as set forth in claim 10 further comprising:

a horizontal support plane of the frame; and a frame cover, wherein the frame cover has a surface, at a periphery thereof, which is supported by the horizontal support plane of the frame, for positioning the frame cover in a vertical direction.

17. The speaker apparatus as set forth in claim 10, wherein the frame projecting portion is formed outside a horizontal support plane of the frame.

18. The speaker apparatus as set forth in claim 10, wherein the outside surface of the frame projecting portion is the only surface of the frame projecting portion that is adhered. to any surface of the diaphragm.

* * * * *